US008561848B2

(12) United States Patent
Gardner

(10) Patent No.: US 8,561,848 B2
(45) Date of Patent: Oct. 22, 2013

(54) EXTENDED CAULKING GUN

(75) Inventor: Ronald Gardner, North Ft. Myers, FL (US)

(73) Assignee: Ronald Gardner, N Ft Myers, FL (US)

( * ) Notice: Subject to any disclaimer, the term of this patent is extended or adjusted under 35 U.S.C. 154(b) by 262 days.

(21) Appl. No.: 12/932,814

(22) Filed: Mar. 8, 2011

(65) Prior Publication Data

US 2012/0228330 A1 Sep. 13, 2012

(51) Int. Cl.
*B67D 5/64* (2006.01)
*B65D 88/54* (2006.01)

(52) U.S. Cl.
USPC ..... 222/174; 222/323

(58) Field of Classification Search
USPC ..... 222/174, 323, 465.1, 469, 475
See application file for complete search history.

(56) References Cited

U.S. PATENT DOCUMENTS 1,418,263 A * 5/1922 Kennedy ..... 81/487
1,672,421 A * 6/1928 Negley ..... 222/391
3,512,684 A * 5/1970 Sutton, Sr. ..... 222/327
3,726,440 A * 4/1973 Deeb ..... 222/174
3,980,209 A * 9/1976 Collar ..... 222/323
4,262,822 A * 4/1981 Corte ..... 222/174
4,932,565 A * 6/1990 Paradiso ..... 222/174
4,979,649 A * 12/1990 Wescott ..... 222/174
5,413,258 A * 5/1995 Kartler ..... 222/575
6,152,332 A * 11/2000 Funk ..... 222/323
6,220,485 B1 * 4/2001 Chang ..... 222/174
D455,619 S * 4/2002 Chang ..... D8/14.1
6,454,136 B1 * 9/2002 Evans ..... 222/174
7,014,070 B1 * 3/2006 Stefely et al. ..... 222/327
2009/0045227 A1 * 2/2009 Abudi ..... 222/174

* cited by examiner

*Primary Examiner* — J. Casimer Jacyna
*Assistant Examiner* — Charles P Cheyney

(57) ABSTRACT

The inventive concept is directed to a caulking gun which has been extended for a considerable length. This extending of the length enables an impaired person to reach areas that need to be caulked. It also enables a person to reach remote areas that only can be reached by a ladder but the person cannot negotiate a ladder. The extension of the basic caulking gun is achieved by placing longitudinal rods between the trigger mechanism and the forward end where the caulking cartridge is normally located. It is important that rods are being used to keep the weight of the gun on a reasonable level. The rods have spaced apart rings in the longitudinal direction to stabilize the rods. At the trigger end of the caulking gun there is located a handle that can be changed in location to accommodate left- and -right handed persons.

3 Claims, 1 Drawing Sheet

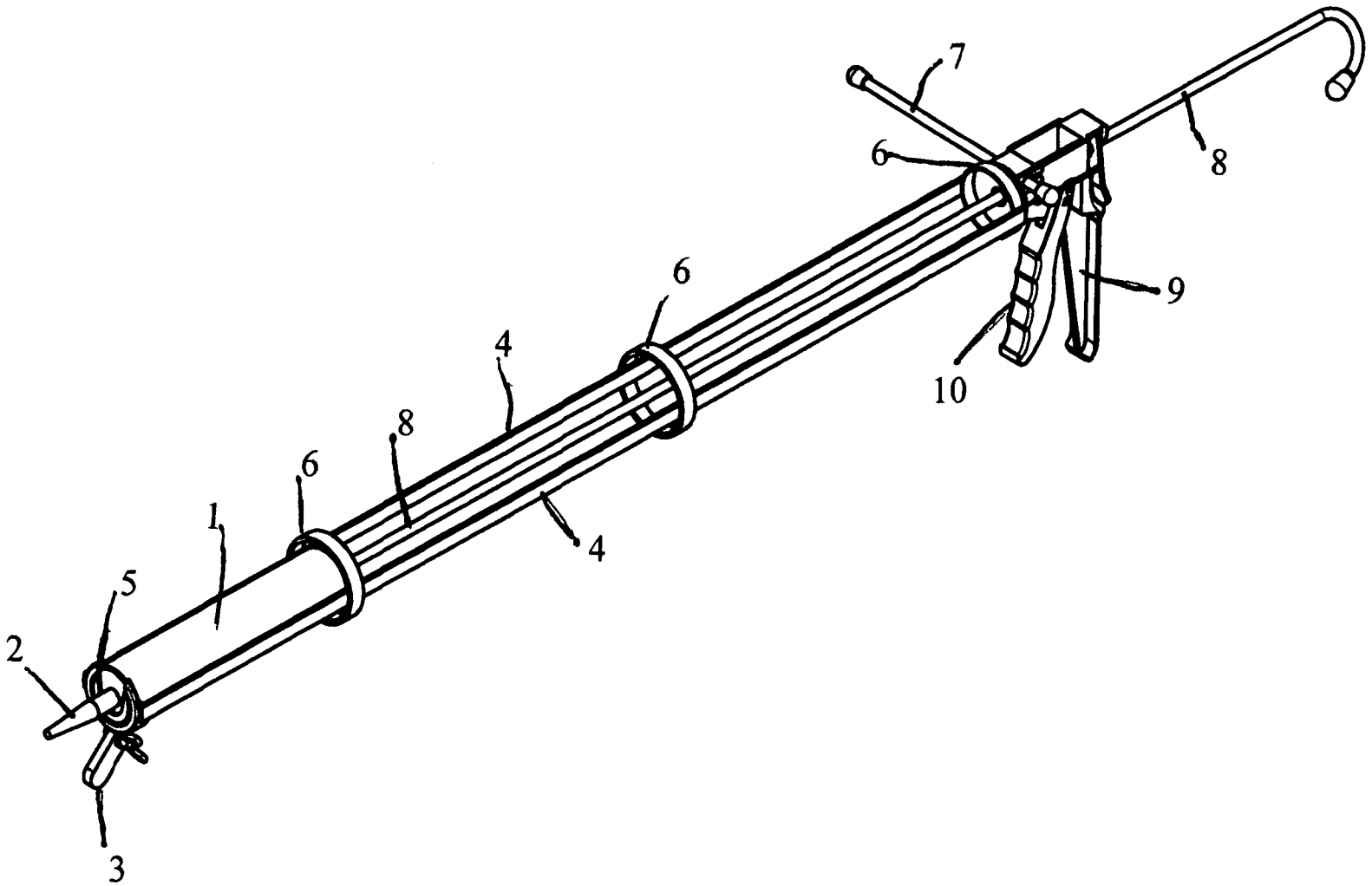
8
9
10
7
6
6
4
4
8
6
1
5
3
2

EXTENDED CAULKING GUN

BACKGROUND OF THE INVENTION

The present invention relates to a dispensing device. More particularly, the invention device relates to a dispensing device capable of applying caulk and like materials to a surface or grooves located near and at a distance from a workman. Home owners and other people try to do the caulking themselves. However, if they are handicapped and cannot bend down or cannot negotiate ladders to reach higher locations that need caulking, this task cannot be performed.

BRIEF DESCRIPTION OF THE INVENTION

The instant invention alleviates the above noted problems by increasing the reach of the caulking gun. It is basically the same as the well known caulking gun except that longitudinal extension rods have been added between the trigger mechanism and the forwardly placed caulk cartridge. At the forward end of the extension a guide has been placed to visually aid the person operating the caulking gun to be accurate in placing the caulking material.

BRIEF DESCRIPTION OF THE DRAWINGS

FIG. 1, (the only FIGURE) is a perspective view of the extended caulking gun.

DETAILED DESCRIPTION OF THE INVENTION

FIG. 1 is a perspective view of the inventive caulking gun. The well known caulking cartridge 1 is placed at the forward end of the extension. The cartridge rests and abuts a dam 5 against which the cartridge is pushed when activated. This is a well known structure. The cartridge 1 has the well known spout 2 at its forward end. A guide 3 is placed at the forward end and at a low forward position. This guide will enable the operator to properly guide the spout 2 and thereby the caulking material into an accurate location. This is essential because of the extended length of the caulking gun the vision of the operator may be somewhat impaired. Between the trigger mechanism 9, 10 and the forward end of the cartridge

1 there are placed several longitudinal and parallel extending rods 4. The rods are stabilized by surrounding rings 6. The rods are deliberately chosen to keep the weight of the extended gun at a minimum and at an acceptable level. The trigger mechanism 9 and 10 is well known consisting of the handle 9 and trigger lever 10. The trigger lever 10 advances the serrations (not shown) on the push rod 8 to advance the pusher rod 8 into the hollow end of the cartridge to dispense the caulking material. The handle 7 is movable from one position to another. This enables a left or right handed person to accurately operate and guide the caulking gun by simply pushing the handle 7 from one side of the gun to the other.

Although the foregoing invention has been described in some detail for purposes of clarity of understanding, it will be apparent that certain changes and modifications may be practiced that are within the scope of the appended claims. Accordingly, the present embodiments are to be considered as illustrative and not restrictive, and the invention is not to be limited to the details given herein, but may be modified within the scope and equivalents of the appended claims.

What I claim is:

1. A caulking gun having a distance leaving an extended space between a forward end to receive a caulking cartridge having caulking material therein and a rear end having a trigger mechanism to advance a push rod, the improvement comprising: the distance including said extended space between said forward end and said rear end being extended to a considerable extent by leaving an extended space between said forward and said rear ends, wherein said extended space consists of several longitudinal and parallel rods, wherein said longitudinal rods are stabilized along their lengths and wherein said stabilization consists of several rings space along said longitudinal rods and surrounding the longitudinal rods.

2. The caulking gun of claim 1 including a handle at said rear end of said trigger end mechanism, said handle can be adjusted for a left- or a right-handed person.

3. The caulking gun of claim 1 including a guide for guiding the caulking material to a correct location, said guide being placed at said forward end and below said forward end and pointing downwardly.

* * * * *